US005697701A

United States Patent [19]

Forrest et al.

[11] Patent Number: 5,697,701

[45] Date of Patent: Dec. 16, 1997

[54] FLUID MIXER PROVIDING GENTLE AGITATION

[75] Inventors: K. Roger Forrest; Ronald M. Kosma, both of Calgary, Canada

[73] Assignee: Fokos Designs, Ltd., Calgary, Canada

[21] Appl. No.: 691,671

[22] Filed: Aug. 2, 1996

[51] Int. Cl.[6] ..... B01F 11/00

[52] U.S. Cl. ..... 366/110; 366/211; 366/215; 366/216; 366/218

[58] Field of Search ..... 366/108, 110, 366/111, 202, 208, 210, 211, 215, 216, 217, 212, 218, 203, 220, 232, 233, 234, 219, 237, 239, 240; 134/117, 118; 68/171

[56] References Cited

U.S. PATENT DOCUMENTS

| | | | |
|---|---|---|---|
| 455,189 | 6/1891 | Farrar | 366/237 |
| 1,774,257 | 8/1930 | English . | |
| 1,898,221 | 2/1933 | Snyder | 366/237 |
| 2,520,685 | 8/1950 | Horvath . | |
| 2,976,792 | 3/1961 | Chambers | 366/208 |
| 3,154,294 | 10/1964 | Bittner | 366/208 |
| 3,181,841 | 5/1965 | Boehm . | |
| 3,212,499 | 10/1965 | Koreski . | |
| 3,235,202 | 2/1966 | Kitselman | 366/237 |
| 3,430,926 | 3/1969 | Freedman et al. | 366/212 |
| 3,679,184 | 7/1972 | Woodham . | |
| 3,861,061 | 1/1975 | Ross | 366/108 |
| 4,373,029 | 2/1983 | Nees . | |
| 4,523,855 | 6/1985 | Walker | 366/237 |
| 4,561,346 | 12/1985 | Marquer | 366/208 |
| 4,747,693 | 5/1988 | Kahl . | |
| 4,750,845 | 6/1988 | Nabetani | 366/208 |
| 4,895,453 | 1/1990 | Devlin et al. | 366/240 |
| 4,943,164 | 7/1990 | Ohishi et al. | 366/111 |
| 5,167,928 | 12/1992 | Kelly . | |
| 5,511,879 | 4/1996 | Fletcher | 366/208 |
| 5,520,884 | 5/1996 | Croucher . | |
| 5,558,437 | 9/1996 | Rode | 366/208 |
| 5,593,609 | 1/1997 | Fletcher | 366/208 |

*Primary Examiner*—Tony G. Soohoo
*Attorney, Agent, or Firm*—Ridout & Maybee

[57] ABSTRACT

A fluid mixing device provides a gentle rotating and concurrent back and forth motion to agitate a fluid. The device has a receptacle with a shaft extending downwardly from a location off center of its bottom to a link arm which is pivotally attached to a reciprocating drive means. A second embodiment of the invention adds a back and forth rotation of the receptacle about its center by attaching a gear to the bottom of the receptacle about its center and providing a partial inside ring gear along which the gear on the receptacle moves pursuant to the reciprocating movement of the shaft. The device is particularly useful for the mixing of biological solutions from lyophilized materials without creating undesirable foams.

19 Claims, 5 Drawing Sheets

FLUID MIXER PROVIDING GENTLE AGITATION

The invention is a fluid mixing device which provides a gentle rotating and concurrent back and forth motion to agitate a fluid. The device is particularly useful for the mixing of blood protein sera or other pharmaceutical or biological fluids without creating a foam.

BACKGROUND OF THE INVENTION

Because many biological materials, such as blood serum proteins, have a limited shelf life in solution, such solutions must include additives to provide an acceptable shelf life. It has been found that the use of reconstituted lyophilized biological materials has certain advantages over the stored solutions. The lyophilized materials can be stored much longer than solutions, and upon reconstitution, they provide fresh solutions which do not contain preservatives.

The reconstituting process must be carefully carried out so that a solution is obtained which possesses the desired properties. When reconstituting blood sera for intravenous administration, for example, it is particularly important to avoid the formation of foams. Prior to the present invention, the preferred method of reconstituting blood sera from lyophilized proteins was to agitate a vial containing the liquid and solid components manually by placing the vial between a person's hands and rotating it back and forth using a rubbing action. While this mixing technique is effective, the mixing time required is at least ten minutes per vial, and in a typically busy medical clinic this procedure inefficiently utilizes valuable time of skilled personnel.

The present invention provides a mechanical mixer which simulates the gentle agitation of the manual mixing method. The invention utilizes a reciprocating drive and a mechanical linkage to impart a back and forth rotation motion to a receptacle which preferably is sized to receive and hold a vial containing the materials to be mixed. The drive is preferably a variable speed drive, and it may be governed by a timer. The invention can be configured to mix a plurality of vials simultaneously. The invention, therefore, meets the need for a gentle mixing device which provides the desired type of mixing without the constant attendance of an operator, thereby freeing skilled personnel to carry out other important tasks.

BRIEF SUMMARY OF THE INVENTION

The invention provides a fluid mixing device for gently agitating fluids, comprising a fluid receptacle having a bottom with a center point and having a shaft extending downwardly from a location off center of the receptacle bottom through a bearing mounted in a fixed support member to a link arm which extends outwardly from the shaft. The shaft is fixed at each end and is rotatable within the bearing. The link arm is pivotally attached to a reciprocating drive means so that a reciprocating movement applied to the link arm by the drive means causes a reciprocating rotation of the shaft and the fluid receptacle.

The invention may be modified to provide circular rotation of the receptacle in addition to the basic back and forth rotation provided by the off-center shaft. In this second embodiment, a gear is attached to the bottom of the receptacle and is centered about the center point of the bottom. A pivot pin extends from a first end of a first link arm to the center of the gear, thereby providing a pivot about which the gear may rotate. A partial inside ring gear having a center point is mounted on a fixed support member and is engaged by the gear attached to the bottom of the receptacle. The first link arm extends outwardly from the pivot pin to a shaft affixed to and extending downwardly from a second end of the first link arm, the shaft passing through a bearing mounted in the support member about the center point of the partial ring gear into attachment with a second link arm which extends outwardly from the shaft substantially parallel to the first link arm. The second link arm is pivotally attached to a reciprocating drive means so that a reciprocating movement applied to the second link arm by the drive means causes a reciprocating rotation of the shaft and a back and forth rotatory movement of the fluid receptacle along the partial ring gear.

Figure 1:
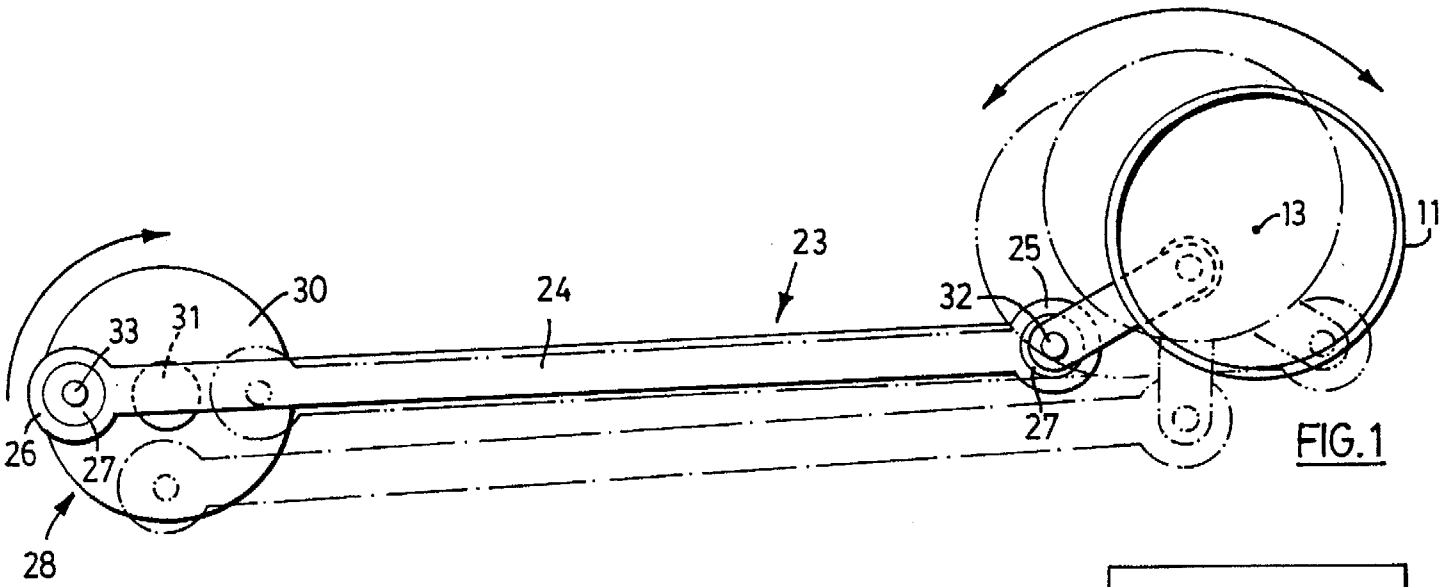
FIG. 1 is a plan view of a detail of the invention showing the drive means and linkage.
Figure 2:
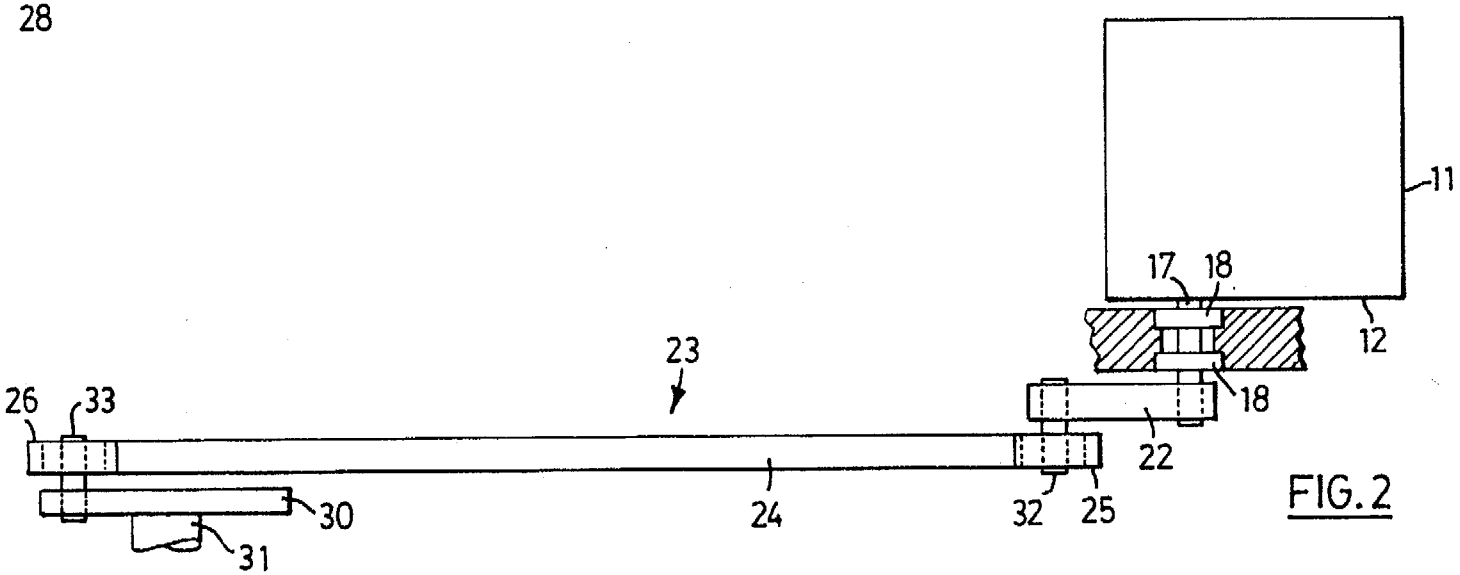
FIG. 2 is a side elevation of the embodiment of FIG. 1.
Figure 4:
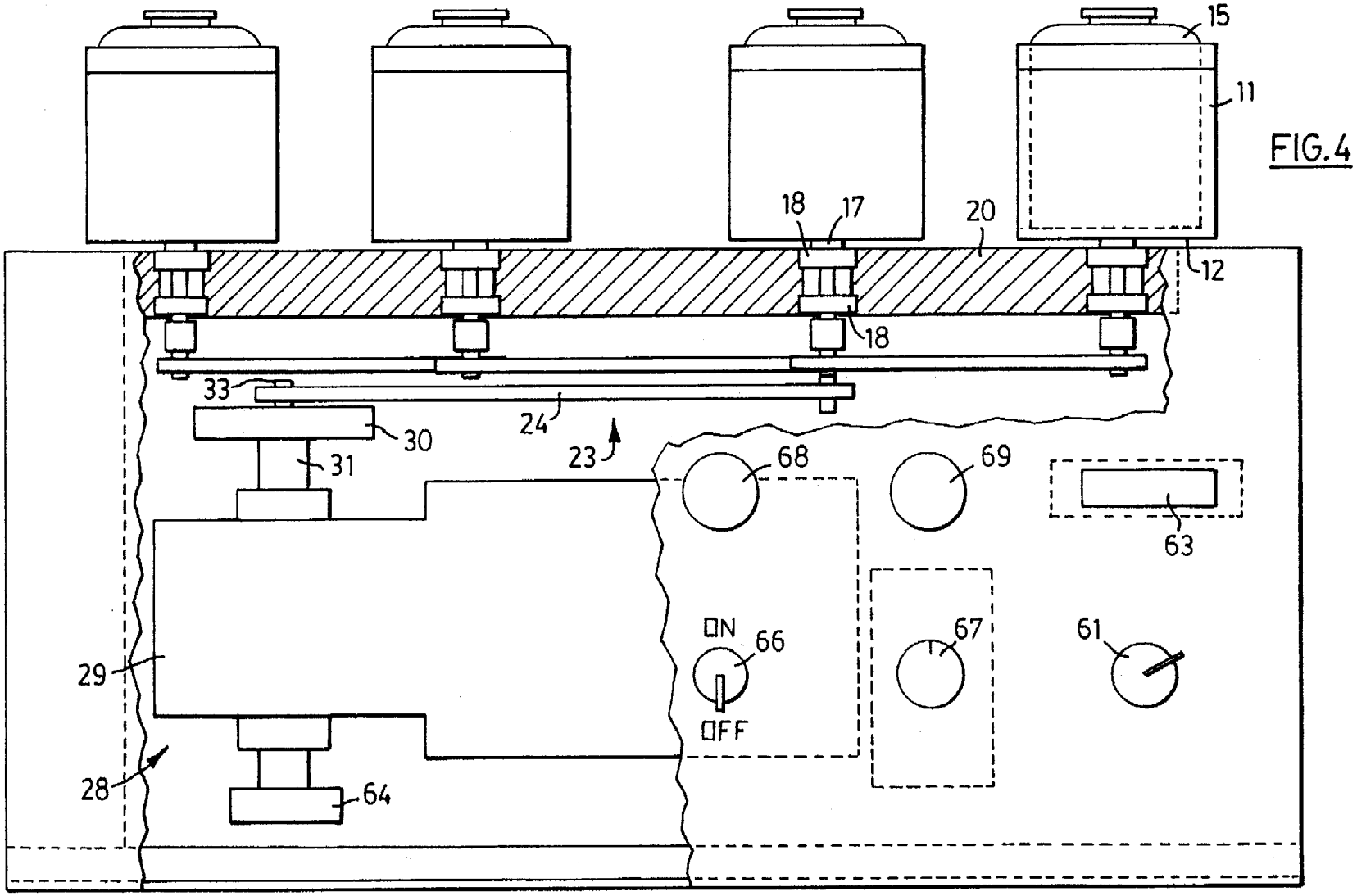
FIG. 4 is a front elevational view, partially broken away, of the device of FIG. 3.

In a first preferred embodiment of the invention as shown in FIGS. 1 and 2, a fluid receptacle 11 has a bottom 12 with a center point 13. Preferably, the receptacle 11 is a cylindrical cup sized to receive a vial 15 of fluid (FIG. 4) to be mixed. Typically, vials 15 range from 25 ml to 500 ml in size. A shaft 17 extends downwardly and is affixed to the bottom 12 at a location off the center point 13. The skilled person will appreciate that the distance from the center point 13 for the attachment of the shaft 17 to the circular bottom 12 depends on the characteristics of agitation which is desired for mixing the fluid. The shaft 17 extends through and is supported by a bearing 18 which is mounted in a fixed support member 20 (FIG. 4). Preferably, two bearings 18 are used for this purpose. All bearings supporting rotatory motion in the device of the invention are preferably ball bearings. The lower end of the shaft 17 is attached to a link arm 22 which extends outwardly from the shaft 17.

A back and forth rotation is imparted to the shaft 17 by a drive linkage 23. Preferably, a reciprocating movement is applied to the link arm 22 by a crankshaft 24 having one end 25 pivotally attached, preferably through a bearing 27, to the outer end of the link arm 22; and the other end 26 of the crankshaft 24 is pivotally attached, preferably through a bearing 27, off center of a circular drive means 28. The circular drive means 28 is preferably a variable speed electric motor 29 equipped with an output wheel 30 centered on an output shaft 31. The pivotal attachment of the crankshaft 24 at each end 25 and 26 may conveniently be accomplished using pins 32 and 33.

Figure 5:
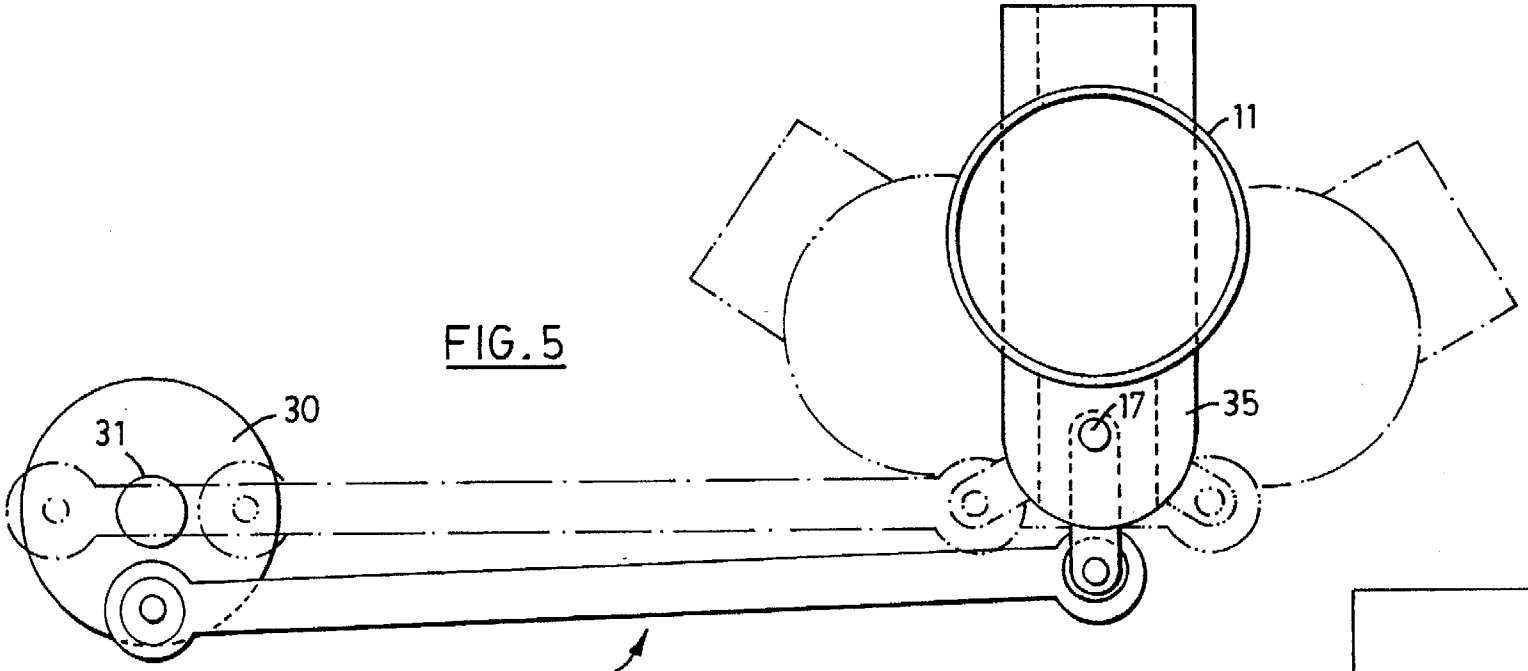
FIG. 5 is a plan view of a variant of the invention of FIG. 1.
Figure 6:
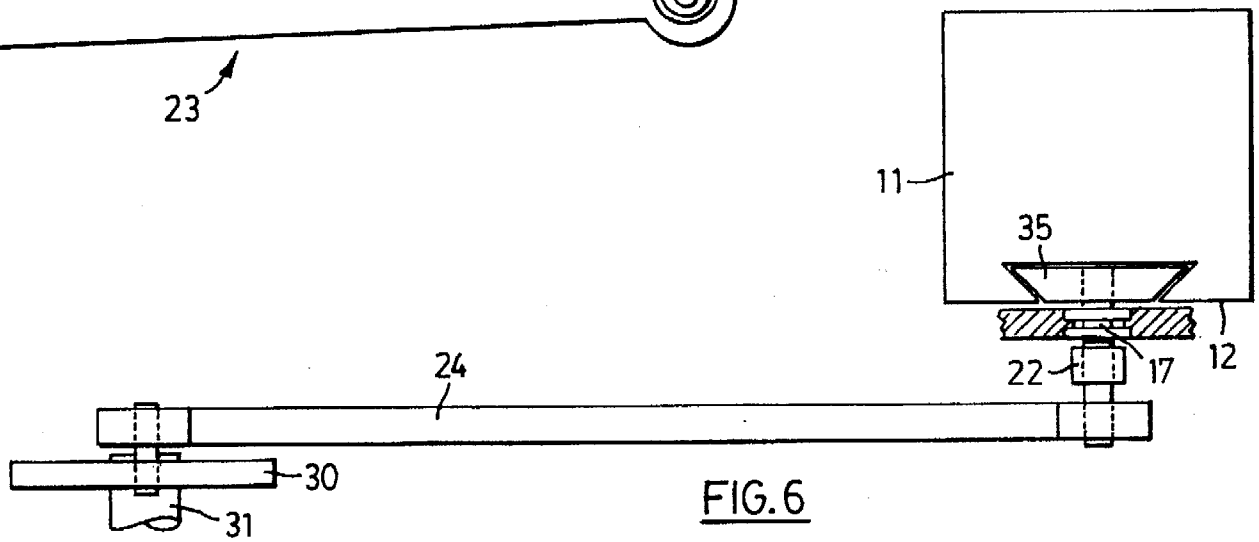
FIG. 6 is a side elevation of the embodiment of FIG. 5.

The skilled person will appreciate that the range and aggressiveness of mixing motion applied to the receptacle 11 can be varied by the selection of attachment points of the shaft 17 to the bottom 12, and by the configuration of the drive linkage 23. For example, as shown in FIGS. 5 and 6, the shaft 17 can be attached at a location beyond the periphery of the bottom 12 of the receptacle 11 by using a lever arm 35 which is attached to and extends from the bottom 12. The lever arm 35 may be adjustable, for example, by using a dovetail connection between the arm 35 and the bottom 12 as illustrated in FIG. 6.

This first preferred embodiment of the invention provides a mixing motion to a vial 15 positioned in the receptacle 11 which approximates the gentle back and forth rotation of manual mixing by rolling the vial 15 back and forth between two palms using a rubbing motion. Using a speed on the order of 90–120 rpm for the motor 29, a vial of 175–200 ml of a 5–10% blood protein serum can be reconstituted from a lyophilized blood protein solid and a suitable liquid in approximately 6–10 minutes without causing the liquid to foam undesirably.

Figure 3:
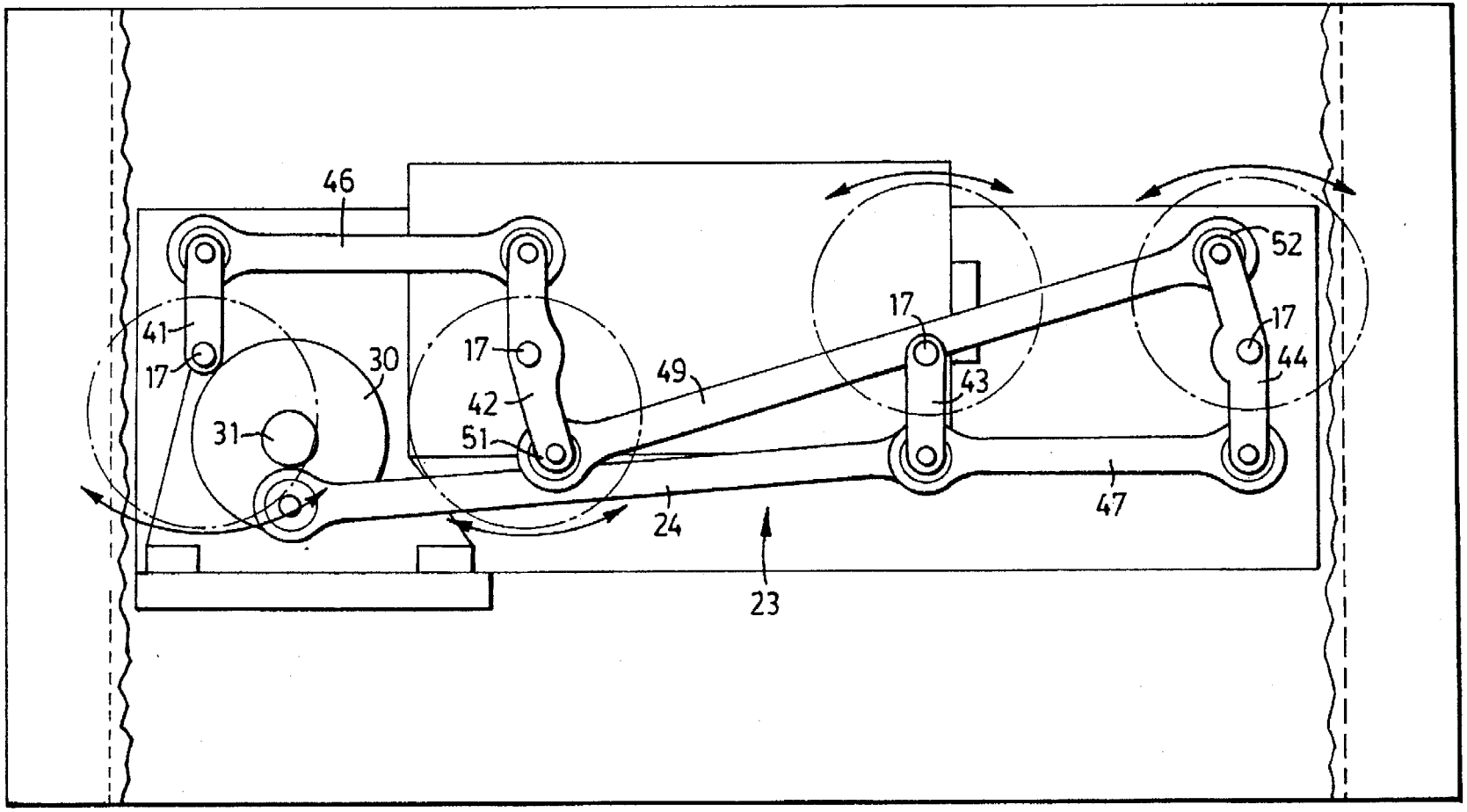
FIG. 3 is a plan view of a linkage arrangement for an embodiment of the invention having four mixing receptacles.

A machine in accordance with this first preferred embodiment of the invention is shown in FIGS. 3 and 4. The drive linkage 23 governing the movement of four receptacles 11 is shown in FIG. 3 where the shafts 17 are aligned centrally of the machine. While the skilled person will appreciate that there are a number of linkage arrangements possible for connecting link arms from the various shafts 17 to the crankshaft 24, the arrangement shown in FIG. 3 is thought to have some advantages because the two pairs of receptacles 11 rotate counter to one another, thereby providing a mass balance for the machine during its operation when mixing two or four vials of fluids. As seen in FIG. 3, the drive linkage 23 comprises link arms 41, 42, 43, and 44 which are connected to the various shafts 17. Link arms 41 and 42 are pivotally connected together by a connector arm 46 and likewise, link arms 43 and 44 are pivotally connected together by a connector arm 47. The link arms 42 and 44 are attached to the respective shafts 17 centrally of the arms so that a connector arm 49 may be pivotally attached diagonally to the ends 51 and 52 of the link arms 42 and 44, as shown in FIG. 3. Preferably, all pivotal connections are supported by bearings 27. This linkage arrangement allows the crankshaft 24 to be pivotally connected to the link arm 43 from the wheel 30 of the motor 29 to provide a reciprocating movement to all four shafts 17 and receptacles 11 with each pair of receptacles 11, i.e., the pair joined by connector arm 46 and the pair joined by connector arm 47, rotating counter to the other.

As shown in FIG. 4, a mixing device of the invention having a drive linkage arrangement 23 as shown in FIG. 3 has a fixed support member 20 in which are mounted bearings 18 for the shafts 17 connected to the bottoms 12 of the four receptacles 11. The bearings 18 are preferably ball bearings. The device is equipped with an electric motor 29 which has means for varying its speed in the range of about 50–170 rpm. The device has a variable speed control 61 and preferably a tachometer 63 which reads the output from a pick up 64 mounted on the output shaft of the motor 29. The device may simply be activated by a power switch 66. Preferably, the device also has a timer 67 to allow mixing to proceed for a specific period so that the device can be left unattended. Indicator lights 68 and 69 may be provided to show whether the device is operating solely under the control of the power switch 66 or whether the device is operating in the timing mode.

Figure 7:
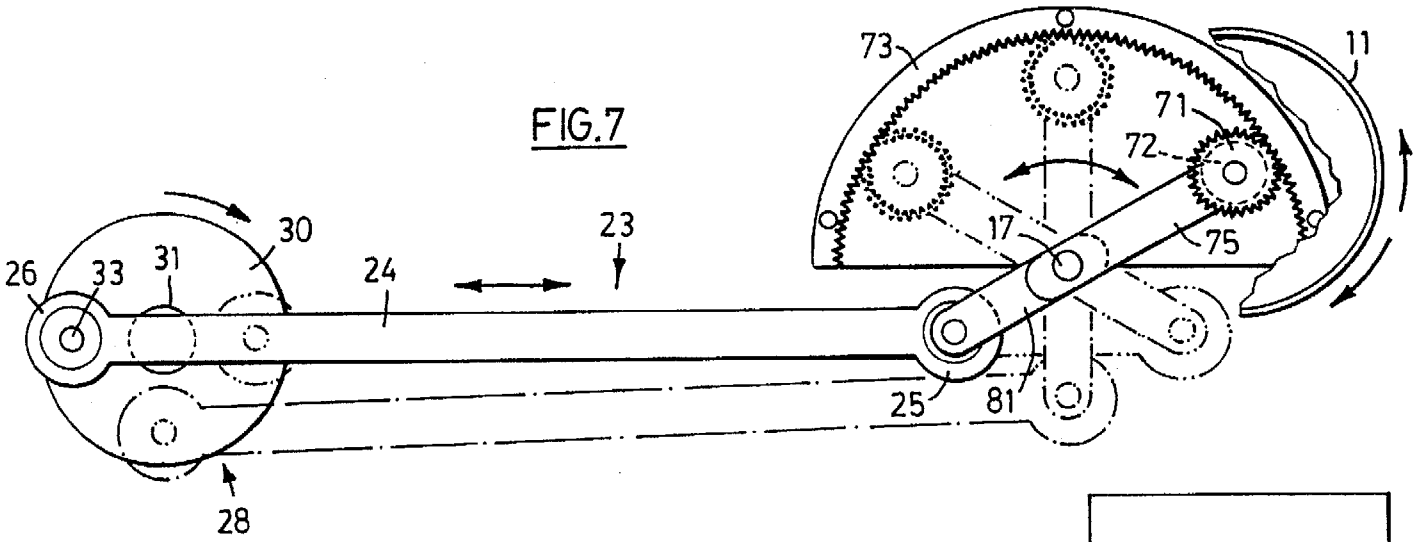
FIG. 7 is a plan view of a second embodiment of the invention showing the drive means and linkage.
Figure 8:
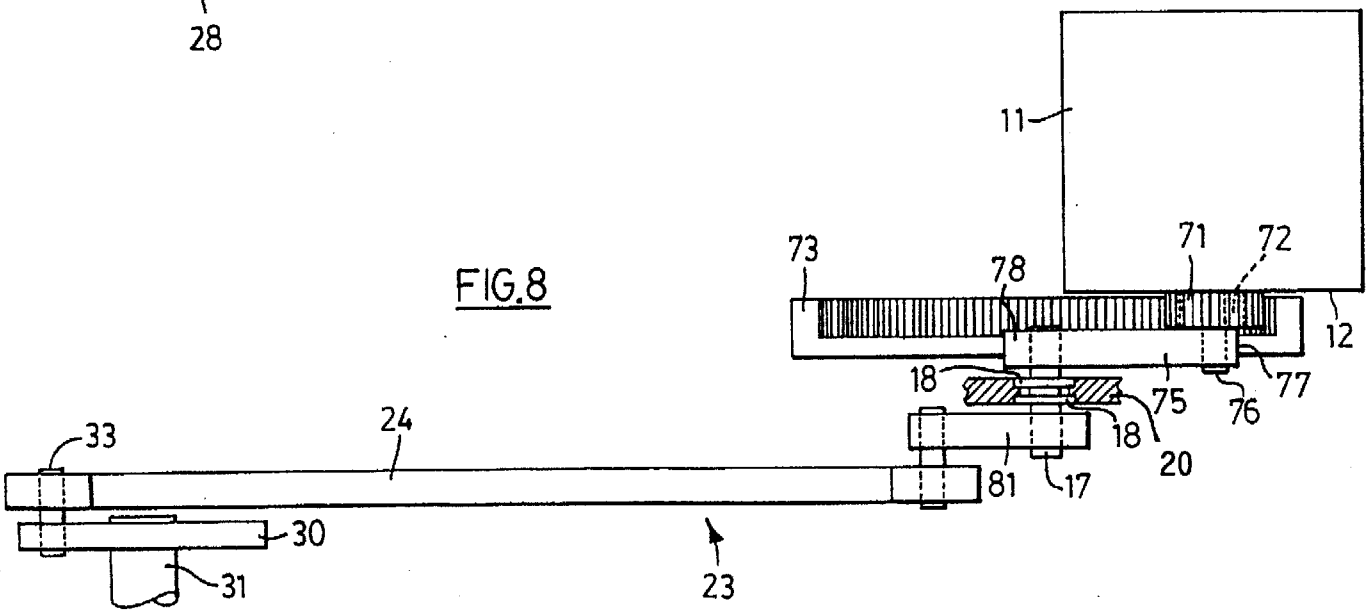
FIG. 8 is a side elevation of the embodiment of FIG. 7.

In a second preferred embodiment of the invention, the receptacle 11 is provided with a back and forth circular rotation about its vertical center axis in addition to the off center rotation provided by the shaft 17. As shown in FIGS. 7 and 8, the receptacle 11 has a gear 71 with an internal bearing 72 mounted on the bottom 12 and centered about the center point 13. A partial inside ring gear 73 is mounted on the fixed support 20 and provides a companion gear along which the gear 71 affixed to the receptacle 11 may travel. The shaft 17 is centered in the support 20 at the center of the partial ring gear 73. A first link arm 75 has a pivot pin 76 at one end 77 about which the gear 71 on the bottom 12 of the receptacle 11 may pivot. The rotation about the pin 76 is supported by the bearing 72. The link arm 75 is attached at its other end 78 to the shaft 17. As with the first embodiment, the shaft 17 is supported by the bearing 18 mounted in the support 20, and a second link arm 81 is attached to the shaft 17 extending through the support 20. The second link arm 81 extends from the shaft 17 substantially in parallel alignment with the first link arm 75. A back and forth rotation is imparted to the shaft 17 by a drive linkage 23 and drive means 28 as described in relation to the first embodiment.

From the foregoing, the skilled person will appreciate that the described embodiments of the invention can be varied within the scope of the invention, and a variety of mixing devices can be designed incorporating the invention as defined in the following claims.

We claim:

1. A fluid mixing device, comprising:

a fluid receptacle having a bottom with a center point;

a shaft having two ends, the shaft having a first end affixed to and extending downwardly from a location off center of the receptacle bottom;

a fixed support member having a bearing mounted in it for engaging the shaft and supporting its axial rotation;

a link arm having two ends, a first end of the link arm being affixed to a second end of the shaft; and a reciprocating drive means for providing a reciprocating movement to a second end of the link arm, the drive means being pivotally connected to the second end of the link arm so that a reciprocating movement applied to the second end of the link arm by the drive means causes a reciprocating axial rotation of the shaft and the fluid receptacle.

2. A fluid mixing device as claimed in claim 1, wherein the receptacle is cylindrical.

3. A fluid mixing device as claimed in claim 2, wherein the receptacle is sized to receive a vial size in the range 25–500 ml.

4. A fluid mixing device as claimed in claim 1, wherein the fixed support has a pair of bearings for engaging the shaft.

5. A fluid mixing device as claimed in claim 4, wherein the bearings are ball bearings.

6. A fluid mixing device as claimed in claim 1, wherein the reciprocating drive means comprises a motor and a drive linkage.

7. A fluid mixing device as claimed in claim 6, wherein the motor has a wheel centered on and attached to an output shaft, and a crankshaft having two ends is pivotally attached at a first end to the wheel off its center and is pivotally attached at a second end to the second end of the link arm.

8. A fluid mixing device as claimed in claim 7, further comprising bearings at the pivotal attachments of the crankshaft to the wheel and link arm.

9. A fluid mixing device as claimed in claim 6, wherein the motor is an electric motor and has means for varying its speed in the range 50–170 rpm.

10. A fluid mixing device, comprising:

a fluid receptacle having a bottom with a center point and having a gear attached to the bottom about the center point;

a first link arm having two ends, a first end of a first link arm has pivot pin affixed to and extending from it to the to the center of the gear, thereby providing a pivot about which the gear may rotate;

a fixed support member for the fluid receptacle;

a partial inside ring gear having a center point is mounted on the fixed support member and is engaged by the gear attached to the bottom of the receptacle;

a shaft having two ends, a first end of the shaft is affixed to and extends downwardly from a second end of the first link arm;

a bearing mounted in the support member about the center point of the partial ring gear, the bearing engages the shaft and supports its axial rotation;

a second link arm having two ends, a first end of the second link arm is affixed to the second end of the shaft and extends outwardly from the shaft substantially in parallel alignment with the first link arm; and a reciprocating drive means for providing a reciprocating movement to second end of the second link arm, the drive means being pivotally connected to the second end of the second link arm so that a reciprocating movement applied to the second end of the second link arm by the drive means causes a reciprocating rotation of the shaft and a back and forth rotatory movement of the fluid receptacle along the partial ring gear.

11. A fluid mixing device as claimed in claim 10, wherein the receptacle is cylindrical.

12. A fluid mixing device as claimed in claim 11, wherein the receptacle is sized to receive a vial size in the range 25–500 ml.

13. A fluid mixing device as claimed in claim 10, wherein the gear attached to the bottom of the receptacle has an internal bearing for supporting the rotation of the gear about the pivot pin.

14. A fluid mixing device as claimed in claim 10, wherein the fixed support has a pair of bearings for engaging the shaft.

15. A fluid mixing device as claimed in claim 14, wherein the bearings are ball bearings.

16. A fluid mixing device as claimed in claim 10, wherein the reciprocating drive means comprises a motor and a drive linkage.

17. A fluid mixing device as claimed in claim 16, wherein the motor has a wheel centered on and attached to an output shaft, and a crankshaft having two ends is pivotally attached at a first end to the wheel off its center and is pivotally attached at a second end to the second end of the second link arm.

18. A fluid mixing device as claimed in claim 17, further comprising bearings at the pivotal attachments of the crankshaft to the wheel and second link arm.

19. A fluid mixing device as claimed in claim 16, wherein the motor is an electric motor and has means for varying its speed in the range 50–170 rpm.

* * * * *